US007107966B2

(12) United States Patent
Tanabe et al.

(10) Patent No.: US 7,107,966 B2
(45) Date of Patent: Sep. 19, 2006

(54) FUEL INJECTION SYSTEM

(75) Inventors: Keiki Tanabe, Tokyo (JP); Shinji Nakayama, Tokyo (JP); Susumu Kouketsu, Tokyo (JP)

(73) Assignee: Mitsubishi Fuso Truck and Bus Corporation, Tokyo (JP)

( * ) Notice: Subject to any disclaimer, the term of this patent is extended or adjusted under 35 U.S.C. 154(b) by 0 days.

(21) Appl. No.: 11/094,470

(22) Filed: Mar. 31, 2005

(65) Prior Publication Data

US 2006/0112934 A1 Jun. 1, 2006

(30) Foreign Application Priority Data

Mar. 31, 2004 (JP) ..... 2004-106455

(51) Int. Cl.
*F02M 37/04* (2006.01)

(52) U.S. Cl. ..... 123/446; 123/456; 123/467

(58) Field of Classification Search ..... 123/467, 123/446, 500, 501, 456, 514
See application file for complete search history.

(56) References Cited

U.S. PATENT DOCUMENTS

| | | | | |
|---|---|---|---|---|
| 4,372,272 | A | 2/1983 | Walter et al. | |
| 4,485,789 | A | 12/1984 | Walter et al. | |
| 4,605,166 | A | 8/1986 | Kelly | |
| 5,697,342 | A | 12/1997 | Anderson et al. | |
| 5,738,075 | A | 4/1998 | Chen et al. | |
| 5,743,237 | A | 4/1998 | Matta | |
| 5,878,720 | A | 3/1999 | Anderson et al. | |
| 6,453,875 | B1 * | 9/2002 | Mahr et al. | 123/446 |
| 6,644,282 | B1 * | 11/2003 | Schwarz | 123/467 |
| 6,776,138 | B1 * | 8/2004 | Mahr et al. | 123/446 |
| 6,845,754 | B1 | 1/2005 | Pecheny et al. | |
| 6,892,703 | B1 * | 5/2005 | Magel | 123/446 |
| 6,910,462 | B1 | 6/2005 | Sun et al. | |
| 6,910,463 | B1 * | 6/2005 | Oshizawa et al. | 123/446 |
| 6,938,610 | B1 * | 9/2005 | Braun et al. | 123/446 |
| 6,962,141 | B1 * | 11/2005 | Kern | 123/446 |
| 7,007,671 | B1 * | 3/2006 | Nakayama et al. | 123/446 |
| 7,040,288 | B1 * | 5/2006 | Nakayama et al. | 123/446 |
| 2005/0034709 | A1 | 2/2005 | Augustin | |

FOREIGN PATENT DOCUMENTS

JP 2002 539372 11/2002

* cited by examiner

*Primary Examiner*—Carl S. Miller
(74) *Attorney, Agent, or Firm*—Jacobson Holman PLLC

(57) ABSTRACT

A booster unit is provided in an injector of a fuel injection system. The booster unit comprises a booster piston accommodated in a pressure chamber, and a discharge valve capable of discharging fuel in a backpressure chamber. A controller has an indication-value setting step of setting an indication value of a target pressure in a common rail in correspondence to an engine operation state, a determination step of determining whether or not the indication value of the pressure in the common rail is in a direction of reduction to be lower in comparison to a previously set indication value, and a step of prolonging an open time of a discharge valve of the booster unit when the determination step has determined that the indication value is in the direction of reduction.

8 Claims, 5 Drawing Sheets

FUEL INJECTION SYSTEM

CROSS-REFERENCE TO RELATED APPLICATIONS

This application is based upon and claims the benefit of priority from prior Japanese Patent Application No. 2004-106455, filed Mar. 31, 2004, the entire contents of which are incorporated herein by reference.

BACKGROUND OF THE INVENTION

1. Field of the Invention

The invention relates to a fuel injection system having a booster unit for use with in an internal combustion engine, such as a diesel engine.

2. Description of the Related Art

Fuel injection systems of a boost type using a common rail system in a diesel engine are generally known. In a fuel injection system of this type, high pressure fuel is used as working fluid fed from the common rail to move a booster piston. The booster piston is provided between a pressure chamber and a backpressure chamber in an injector. The booster piston is moved in accordance with a differential pressure occurring between the pressure chamber and the backpressure chamber when the fuel in the backpressure chamber is discharged. The fuel intensified by the booster piston is transferred to a needle valve mechanism of a nozzle portion of the injector.

A fuel injection system is disclosed in, for example, a Japanese patent document (PCT. National Publication No. 2002-539372). The fuel injection system disclosed therein includes a needle valve drive unit that actuates a needle valve of the needle valve mechanism. The needle valve drive unit includes a pressurization chamber that admits fuel fed from a common rail; an open/close valve capable of discharging fuel in the pressurization chamber; and a pressure-receiving piston accommodated in the pressurization chamber. The needle valve drive unit opens the needle valve in conjunction with the discharge of fuel being preserved in the pressurization chamber.

In fuel injection systems of the type described in the patent document, a large amount of fuel is used to operate the booster unit. As such, in comparison to a fuel injection system without a booster unit, a common rail with a large capacity is necessary depending on the type.

The common rail pressure is controlled to an optimal value through, for example, adjustment of the amount of feed from a supply pump in correspondence to the engine operation mode. For example, in the event that the engine is running on high load and high speed, the supply pump is controlled to cause the common rail pressure to be higher than in the event that the engine is running on low load and low speed.

Under these circumstances, demand arises in that the common rail pressure is controlled to lower in a short time in an engine transient state, such as in the event that the engine load state transitions from a high load state to a low load state, and an accelerator opening (i.e., the amount of acceleration pedal operation) transitions from a large state to a small state. However, in a common rail having a relatively large capacity suited to a booster unit, it takes a time for pressure reduction, thereby causing a response delay. As such, there can occur high pressure injection of fuel in a low load state, wherein it is contemplated that inverse effects are imposed on exhaust gas, etc.

BRIEF SUMMARY OF THE INVENTION

Accordingly, the invention is to provide a fuel injection system that enables the pressure to be quickly reduced in response to an event where the necessity has arisen for reducing the pressure in the common rail in correspondence to the operation mode.

A fuel injection system of the present invention comprising a common rail, a booster unit, a needle valve drive unit, and a controller. The booster unit has: a pressure chamber which admits the fuel transferred from the common rail; an booster piston provided in the pressure chamber; a backpressure chamber which is separated by the booster piston from the pressure chamber and which admits the fuel transferred from the common rail; a discharge valve which is able to discharge the fuel existing in the backpressure chamber; and a booster chamber which, when the fuel in the backpressure chamber is discharged, uses a portion moving integrally with the booster piston thereby to intensify the fuel and then transfers the fuel to the needle valve mechanism. The needle valve drive unit has: a pressurization chamber which admits the fuel transferred from the common rail; an open/close valve which is able to discharge the fuel existing in the pressurization chamber; and a pressure-receiving piston which is accommodated in the pressurization chamber and moves in the direction of opening the needle valve in conjunction with discharge of the fuel existing in the pressurization chamber. And the controller has prolongation means for prolonging an open time of the discharge valve when the booster unit operates in the event that necessity arises for reducing pressure in the common rail in correspondence to any one of an engine operation state and accelerator operation state.

According to the invention, in a fuel injection system using a booster unit and a common rail, the pressure in the common rail can be quickly reduced in response to an event where the necessity has arisen for reducing the pressure in the common rail, such as in an event where the state transitions from a high load state to a low load state in correspondence to the engine operation mode.

According to a preferred embodiment of the present invention, the controller further comprises: indication-value setting means for setting an indication value of a target pressure in the common rail in correspondence to the engine operation state; and determination means for determining whether or not the indication value of the pressure in the common rail is in a direction of reduction to be lower in comparison to a previously set indication value, wherein, when the determination means has determined that the indication value is in the direction of reduction, the prolongation means prolongs the open time of the discharge valve of the booster unit.

According to a preferred embodiment of the present invention, when the determination means has determined that the indication value is in the direction of reduction and an amount of the reduction exceeds a predetermined value, the prolongation means of the controller prolongs the open time of the discharge valve of the booster unit.

According to a preferred embodiment of the present invention, the indication-value setting means of the controller causes the indication value to increase when an engine speed and an engine load increase.

According to a preferred embodiment of the present invention, the prolongation means acquires a maximum prolongation time ΔTe (seconds) for prolongation by:

$$\Delta Te=(120/Ne)-(t)-(\Delta Taf+\Delta Tred)$$

where Ne represents an engine speed (rpm); t represents an injection period; ΔTred represents a time necessary for reducing the pressure in an injector; and ΔTaf represents a setting margin time.

According to a preferred embodiment of the present invention, while the open time of the discharge valve is prolonged by the prolongation means, the controller causes a feed rate of a supply pump to supply the fuel to the common rail to be reduced or to be zero.

According to another embodiment of the controller, the controller further has determination means for determining whether or not an accelerator opening is in a direction of reduction, and when the determination means has determined that the accelerator opening is in the direction of reduction, the prolongation means prolongs the open time of the discharge valve of the booster unit.

For example, while the open time of the discharge valve is prolonged by the prolongation means, the controller causes a feed rate of a supply pump to supply the fuel to the common rail to be reduced or to be zero.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
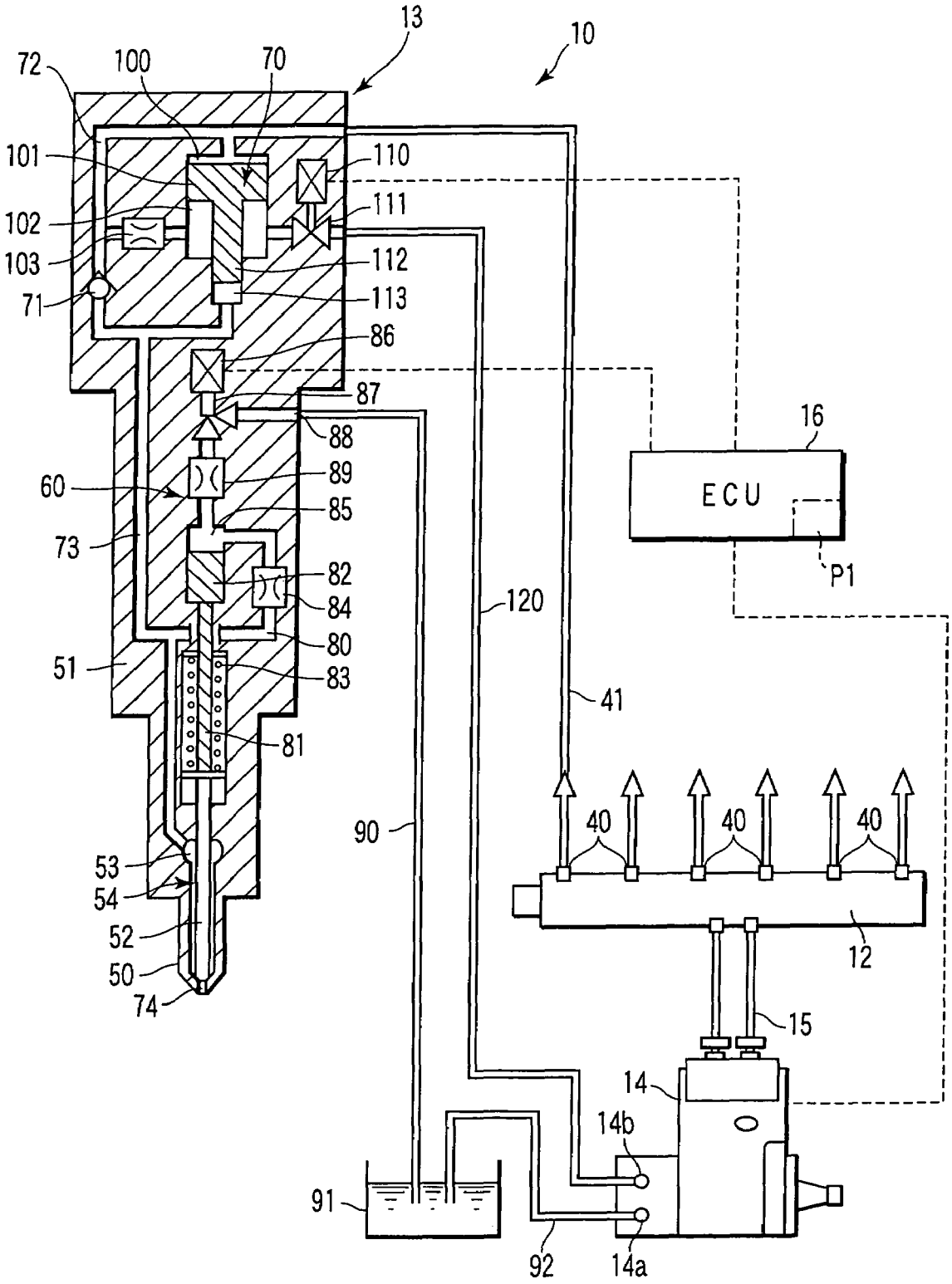
FIG. 1 is a cross sectional view showing a fuel injection system of a first embodiment according to the invention.
Figure 6:
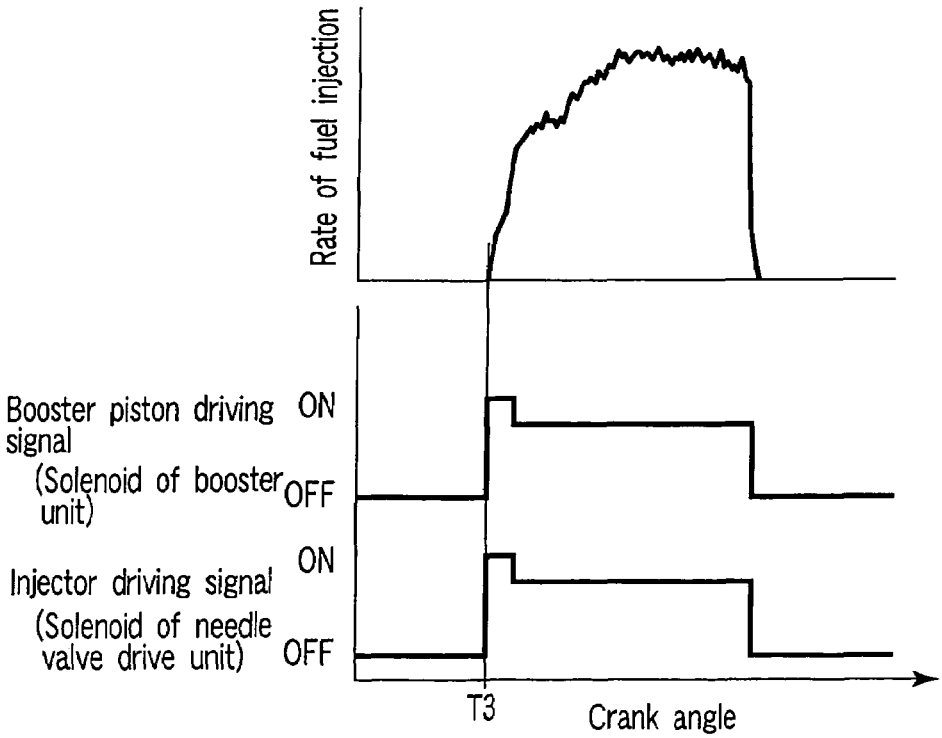
FIG. 6 is a diagram showing other examples of a booster piston driving signal and an injector driving signal in the fuel injection system shown in FIG. 1.

With reference to FIGS. 1 and 6, a first embodiment of the invention will be described herebelow.

FIG. 1 shows a fuel injection system 10 that is used in a diesel engine that is exemplified for an engine. The fuel injection system 10 includes members such as a common rail 12, an injector 13, and a supply pump 14 that functions as a fuel pump. The common rail 12 preserves pressurized fuel. The injector 13 is provided in units of a cylinder of the engine. The supply pump 14 pressurizes fuel and supplies the fuel to the common rail 12. The common rail 12 and the supply pump 14 are interconnected by fuel feed pipes 15. The supply pump 14 is controlled by a controller 16 for a discharge amount so that the fuel pressure in the common rail 12 becomes a fuel pressure of a desired value or zero.

A plurality of discharge ports 40 are formed in the common rail 12. The discharge ports 40 supply the fuel to the injectors 13 for the cylinders, respectively. Only one of the injectors 13 is shown in FIG. 1. Practically, however, the injectors 13 of the cylinders are, respectively, connected to the discharge ports 40 of the common rail 12 through a fuel feed passage 41, wherein the fuel is fed to the respective injectors 13.

The injector 13 includes a body 51 having a nozzle portion 50, a needle valve mechanism 54, a needle valve drive unit 60, and a booster unit 70. The needle valve mechanism 54 includes a needle valve 52 provided in a portion close to the nozzle portion 50, and a fuel chamber 53. The needle valve drive unit 60 moves the needle valve 52 along the direction of opening/closing the needle valve 52. The booster unit 70 intensifies the fuel fed from the common rail 12, thereby to feed the intensified fuel to the needle valve mechanism 54.

A fuel circulation portion 72 having a check valve 71 is formed in the injector 13. The fuel circulation portion 72 is connected to the common rail 12 through the fuel feed passage 41. The fuel fed from the common rail 12 is fed toward the fuel chamber 53 through the fuel circulation portion 72, the check valve 71, and a fuel circulation portion 73. The fuel circulation portion 73 is disposed in communication with the nozzle portion 50. A fuel injection hole 74 is formed to an end portion of the nozzle portion 50.

The needle valve drive unit 60 includes, for example, a fuel passage 80, a pressure-receiving piston 82, a spring 83, a pressurization chamber 85, an open/close valve 87, a return fuel outlet 88, and a orifice 89. The fuel passage 80 is formed in the body 51. The pressure-receiving piston 82 includes a drive shaft 81 that moves integrally with the needle valve 52 in the axial direction. The spring 83 urges the needle valve 52 in the closing direction. The pressurization chamber 85 is disposed in communication with the fuel passage 80 through an orifice 84. The open/close valve 87 is actuated by a solenoid 86. The return fuel outlet 88 is formed in communication with a discharge side of the open/close valve 87.

The return fuel outlet 88 is disposed in communication with a fuel tank 91 through a return passage 90. The return passage 90 is formed in communication with a discharge side of the open/close valve 87 of the needle valve drive unit 60 and with the fuel tank 91. The fuel tank 91 is placed in communication with an inlet 14*a* of the supply pump 14 through a fuel feed pipe 92.

The booster unit 70 includes a pressure chamber 100, a booster piston 101, and a backpressure chamber 102. The pressure chamber 100 is disposed in communication with the fuel feed passage 41. The booster piston 101 is accommodated in the pressure chamber 100. The backpressure chamber 102 is separated by the booster piston 101 from the pressure chamber 100. The backpressure chamber 102 is disposed in communication with the fuel circulation portion 72 through an orifice 103. High pressure fuel supplied from the common rail 12 through the fuel feed passage 41 is admitted into the pressure chamber 100 and the backpressure chamber 102.

The booster unit 70 further has a discharge valve 111, a plunger portion 112, and a booster chamber 113. The discharge valve 111 is driven by a solenoid 110 to open when the fuel preserved in the backpressure chamber 102 is discharged. The plunger portion 112 moves integrally with the booster piston 101 when the fuel in the backpressure chamber 102 is discharged. With the operation of the plunger portion 112, the booster chamber 113 pressurizes fuel.

The booster chamber 113 is disposed in communication with the fuel circulation portion 73. A fuel discharge passage 120 is connected to the outlet side of the discharge valve 111. The fuel discharge passage 120 is coupled to an inlet side 14*b* of the supply pump 14. In this case, the fuel discharged from the backpressure chamber 102 can be returned to the inlet side 14*b* of the supply pump 14, thereby being able to save the fuel being supplied to supply pump 14.

The solenoid 86 of the open/close valve 87 and the solenoid 110 of the discharge valve 111 are individually controlled by the controller 16 for their opening/closing operation. The supply pump 14 is controlled by the controller 16 for the feed rate (pumping volumetric flow rate) of the fuel to the common rail 12. The controller 16 is formed using an in-vehicle computer such as an ECU (electronic control unit), for example. When the injector 13 requires intensification, the controller 16 controls the solenoid 110 of the booster unit 70 to turn ON. In synchronization with the above or with a slight delay after the above, the controller 16 controls the solenoid 86 of the needle valve drive unit 60 to turn ON.

As an indication-value setting means (or, an indication-value setting step) as defined in the appended claims of the invention, the controller 16 contains a computer program P1 ("program," hereafter) that sets a desired indication value of the common rail pressure corresponding to the operation mode of the engine. For example, the indication value of the common rail pressure is set corresponding to the engine speed and the engine load by use of a common rail pressure map exemplified in FIG. 2.

Figure 2:
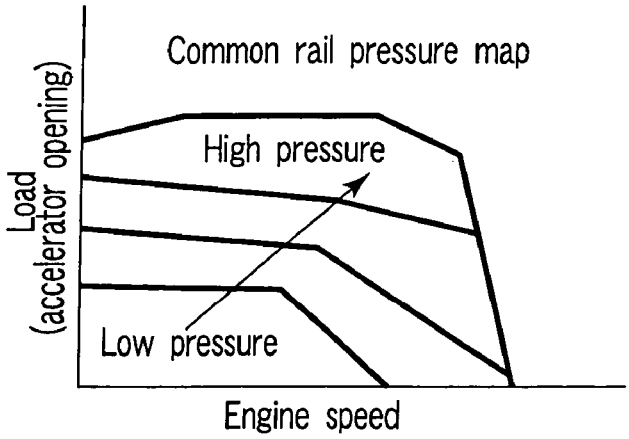
FIG. 2 is a view showing a common rail pressure map based on an engine speed and an engine load.

According to the common rail pressure map of FIG. 2, the indication value of the common rail pressure is set to increase as the engine speed and the engine load (accelerator opening) increase. In the present Specification, the "accelerator opening" corresponds to the amount of acceleration pedal operation. The operation of supply pump 14 is controlled so that the common rail pressure nears the indication value.

Figure 3:
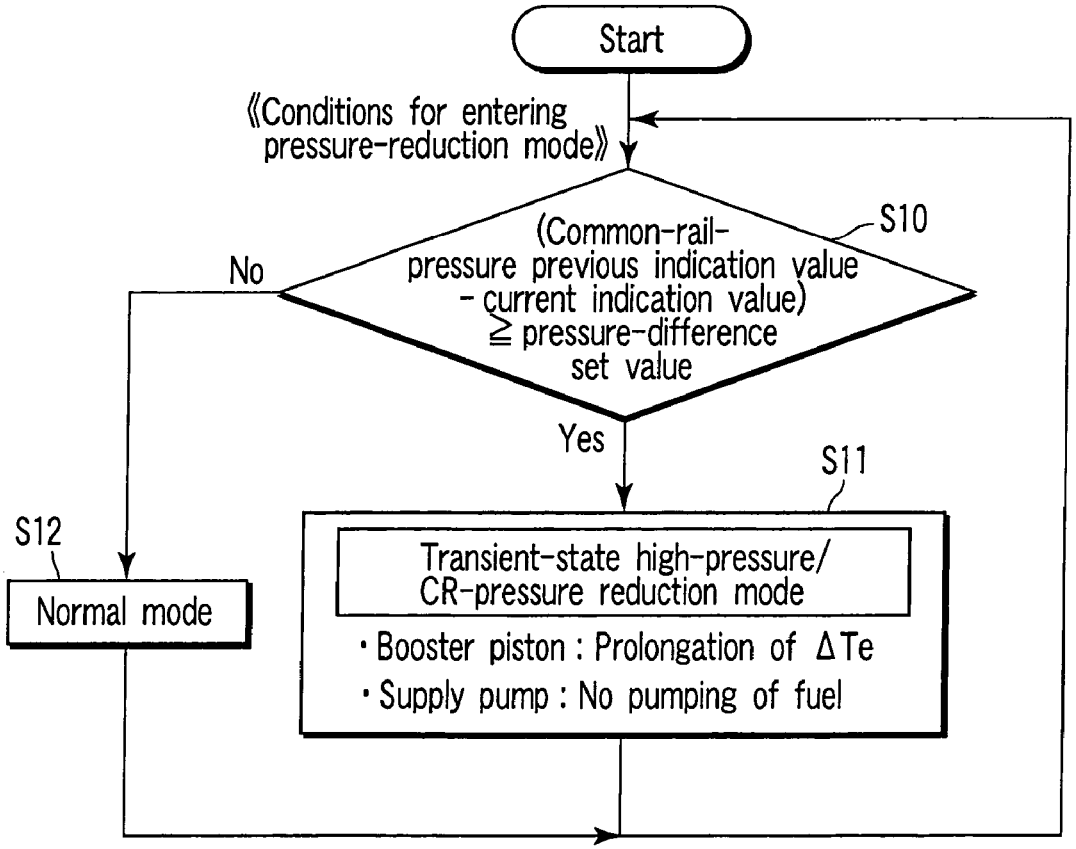
FIG. 3 is a view showing a part of functions of a controller of the fuel injection system shown in FIG. 1.

Further, the controller 16 includes step S10 shown in FIG. 3, as determination means (or, a determination step) as defined in the appended claims of the invention. In step S10, each time fuel injection is performed (or, at a predetermined interval), a program routine performs a comparison between a current indication value of the common rail pressure and a previously set indication value, thereby to determine whether or not the indication value is in the direction of reduction.

In the event that, in step S10, the difference between the current indication value and the previous indication value has become greater than or equal to a preset pressure-difference set value, that is, the reducing amount in the indication value has exceeded a preset value, the operation proceeds to step S11 (pressure-reduction mode). Step S11 performs prolongation processing described below. Step S11 functions as prolongation means (prolongation step) as defined in the appended claims of the invention.

If in step S10 the difference between the current indication value and the previous indication value is less than the preset pressure-difference set value, the operation proceeds to step S12 (normal mode). In step S12, the prolongation processing described below is not executed. In step S12, in accordance with a normal booster-piston driving signal (shown by a double-dotted chain line N in FIG. 4), the discharge valve 111 is actuated for a minimum time necessary for intensification, and the booster piston 101 is thereby driven.

In step S11, if in step S10 it is determined the indication value is in the direction of reduction, an open time of the discharge valve 111 of the booster unit 70 is set longer than in the case where the indication value is not in the direction of reduction. Specifically, an open time of the discharge valve 111 is prolonged by a prolongation time ΔTe (seconds), as shown by a solid line E in FIG. 4.

Figure 4:
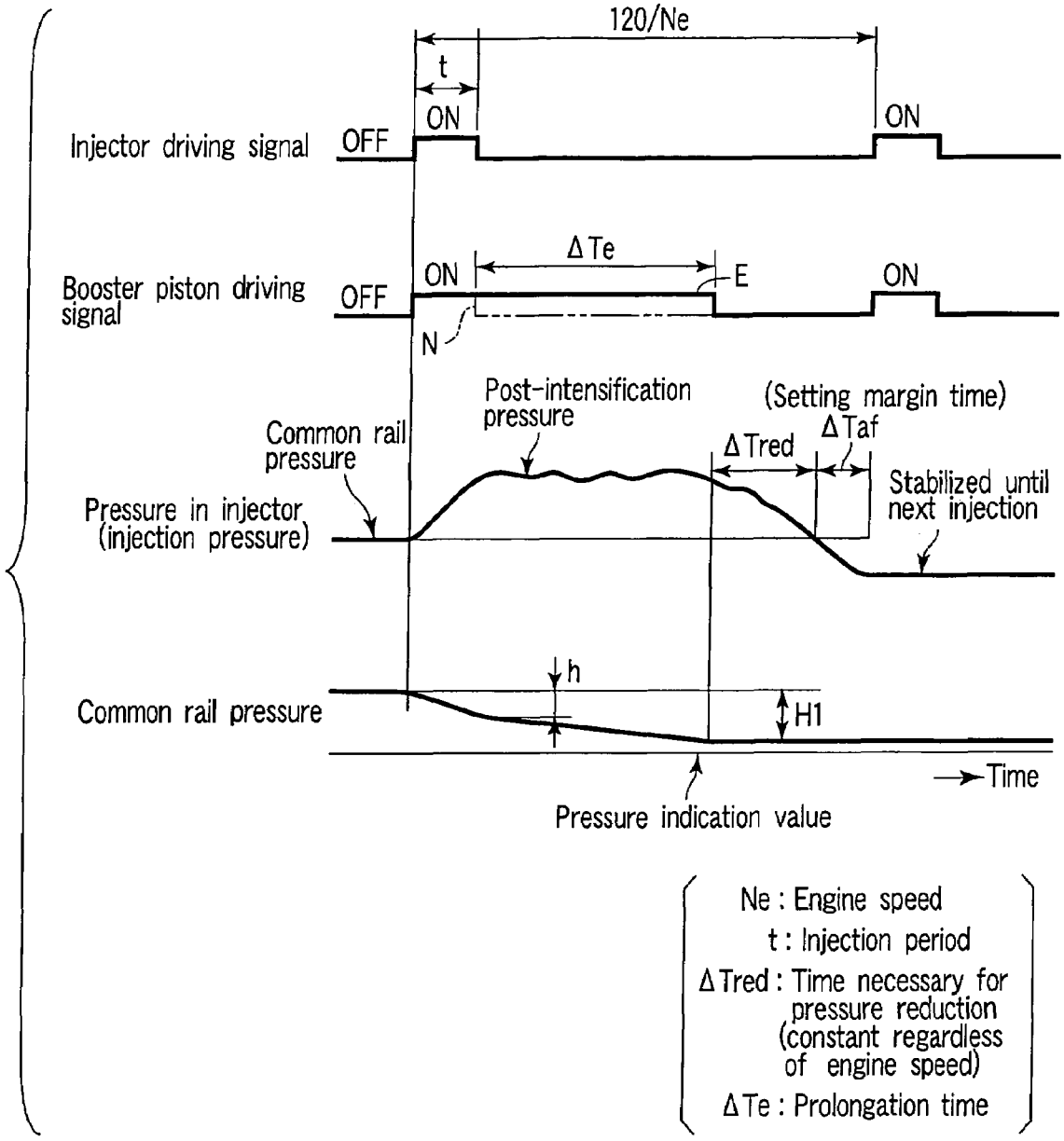
FIG. 4 is a diagram showing relationships between driving signals, injection pressures, and common rail pressures in the fuel injection system shown in FIG. 1.

A maximum value of the prolongation time ΔTe (second) is calculated by equation (1) below:

$$\Delta Te=(120/Ne)-(t)-(\Delta Taf+\Delta Tred) \quad (1)$$

wherein, as shown in FIG. 4, Ne is an engine speed (rpm); t is an injection period; ΔTred is a time necessary for reducing the pressure in the injector; and ΔTaf is a setting margin time.

The controller 16 further controls the operation of the supply pump 14. More specifically, the controller 16 controls the operation of the supply pump 14 so that the feed rate of fuel to the common rail 12 becomes zero (no-pumping) when an open time of the discharge valve 111 is prolonged by a prolongation time ΔTe in step S11. In this case, instead of controlling the supply pump 14 so that the feed rate the no-pumping state, the supply pump 14 might be controlled so that the feed rate nears zero.

Operation of the fuel injection system 10 according to the present embodiment will now be described herebelow with reference to FIGS. 1 to 6.

When the engine operates and the supply pump 14 is actuated, fuel drawn into the supply pump 14 from the fuel tank 91 is thereby pressurized. The pressurized fuel is then fed to the common rail 12. The pressure of fuel being discharged from the supply pump 14 is regulated by the controller 16 in correspondence to the operation mode of the engine. The fuel pressurized by the supply pump 14 to a predetermined pressure is preserved in the common rail 12.

The fuel is injected into a combustion chamber of the respective cylinder of the engine from the fuel injection hole 74 of the corresponding injector 13. The injector 13 is actuated in any one of a fuel intensification mode (mode in which the booster unit 70 operates) and fuel non-intensification mode (mode in which the booster unit 70 does not operate) in correspondence to the operation mode of the engine. For example, the injector 13 operates in the fuel intensification mode during high load operation of the engine. On the other hand, the injector 13 operates in a mode not requiring fuel intensification during low load operation, such as during idling of the engine.

Figure 5:
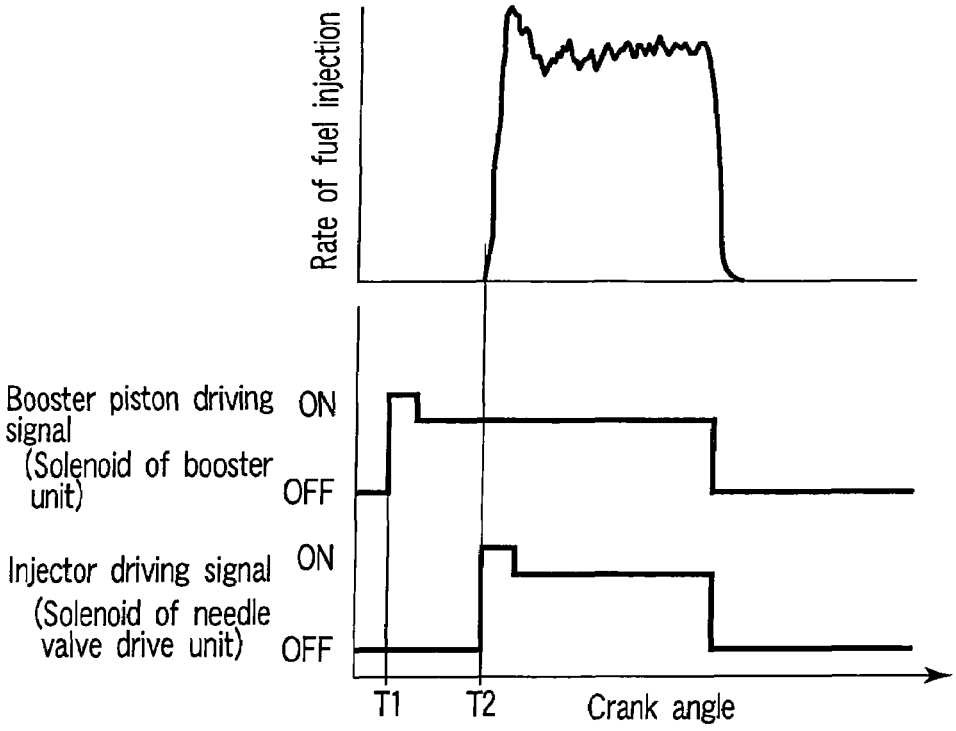
FIG. 5 is a diagram showing examples of a booster piston driving signal and an injector driving signal in the fuel injection system shown in FIG. 1.

With reference to FIG. 5, for example, in the fuel intensification mode, the solenoid 110 of the booster unit 70 is turned ON in response to a booster-piston driving signal at a crank angle T1 indicated on the horizontal axis of the figure. When the solenoid 110 is turned ON, the discharge valve 111 opens. Thereby, the booster piston 101 moves toward the booster chamber 113 in correspondence to a pressure-receiving area ratio between the booster piston 101 and the plunger portion 112. In conjunction with the movement, fuel in the backpressure chamber 102 is led to travel through the discharge valve 111 and is then discharged to the fuel discharge passage 120. Consequently, the fuel in the booster chamber 113 is intensified and transferred to the fuel circulation portion 73. The high pressure fuel discharged from the backpressure chamber 102 to the fuel discharge passage 120 is returned to the inlet side 14*b* of the supply pump 14.

At a crank angle T2 shown in FIG. 5, the solenoid 86 of the needle valve drive unit 60 is turned ON in response to an injector driving signal. When the solenoid 86 is turned ON, the open/close valve 87 opens. Thereby, the fuel in the pressurization chamber 85 is discharged from the return fuel outlet 88 to the return passage 90 through the open/close valve 87. With this operation, the pressure-receiving piston 82 is moved in the direction opposite to the needle valve 52, thereby to open the needle valve 52. Consequently, fuel in the fuel chamber 53 is injected into the combustion chamber of the engine from the fuel injection hole 74. The fuel discharged from the pressurization chamber 85 to the return fuel outlet 88 returns to the fuel tank 91.

Reference is now made to FIG. 6. As shown therein, depending on the operation mode of the engine, an event can occur in which the booster-piston driving signal and the injector driving signal are issued substantially at the same time at a crank angle T3. In this event, substantially at the same time the solenoid 110 of the booster unit 70 is turned ON, the solenoid 86 of the needle valve drive unit 60 is turned ON, whereby the fuel injection is started. As such, booting in the rate of fuel injection at the start time of injection is caused to be slow.

In the operation mode not requiring intensification for the injector 13, the solenoid 110 of the booster unit 70 remains OFF. In this mode, the solenoid 86 of the needle valve drive unit 60 is turned ON, and the open/close valve 87 opens. Thereby, the fuel in the pressurization chamber 85 is discharged to the return passage 90 from the open/close valve 87, similarly as the case described hereinabove. Concurrently, the pressure-receiving piston 82 moves toward the needle valve 52, and the needle valve 52 opens. When the needle valve 52 opens, the fuel is injected from the fuel injection hole 74. In this case, the fuel is injected only by using the pressure being exerted by the common rail 12, so that the injection pressure is relatively low.

The pressure in the common rail 12 is adjustable through adjustment of the pumping volumetric flow rate of the fuel being supplied from the supply pump 14 in correspondence to the operation mode of the engine. For example, in the mode of high load, high speed operation of the engine, the indication value is set to allow the pressure in the common rail to become higher by using the common rail pressure map as shown in FIG. 2.

As already described above, in step S10 shown in FIG. 3 when the difference between the current indication value and the previous indication value has become greater than or equal to the preset pressure-difference set value, the operation proceeds to step S11 (pressure-reduction mode). Thereby, the open time of the discharge valve 111 of the booster unit 70 is prolonged by ΔTe, and the feed rate of fuel to the common rail 12 becomes zero (no-pumping).

In the event that the operation has proceeded to step S11, the injector driving signal remains OFF until the prolongation time ΔTe elapses. During this event, since the needle valve 52 does not open, the booster piston 101 is essentially stopped. As the discharge valve 111 remains open, the fuel drawn into the backpressure chamber 102 through the fuel circulation portion 72 and the orifice 103 from the common rail 12 is discharged to the fuel discharge passage 120 through the discharge valve 111. Thereby, the pressure in the common rail 12 is reduced in a short time to a level close to the indication value. Hi shown in FIG. 4 represents a pressure reduction amount in the prolongation step S11. When the prolongation step S11 is unexecuted, the pressure reduction amount is only an amount shown by h in FIG. 4.

As described above, the controller 16 includes the prolongation means (step S11). Accordingly, even with a fuel injection system 10 using a common rail 12 having a relatively large capacity for being used to operate the booster unit 70, in the transient state of the engine such as in the state of transition from a high speed, high load zone to a low speed, low load zone, the pressure in the common rail 12 can be reduced in a short time. Consequently, occurrence of a response delay in such a transient state can be restrained, high pressure fuel injection can be prevented from being executed in a low load state, and hence exhaust gas emissions can be maintained in a preferable condition. In particular, the control described above is effective to reduce $NO_x$ contained in exhaust gas emissions.

Figure 7:
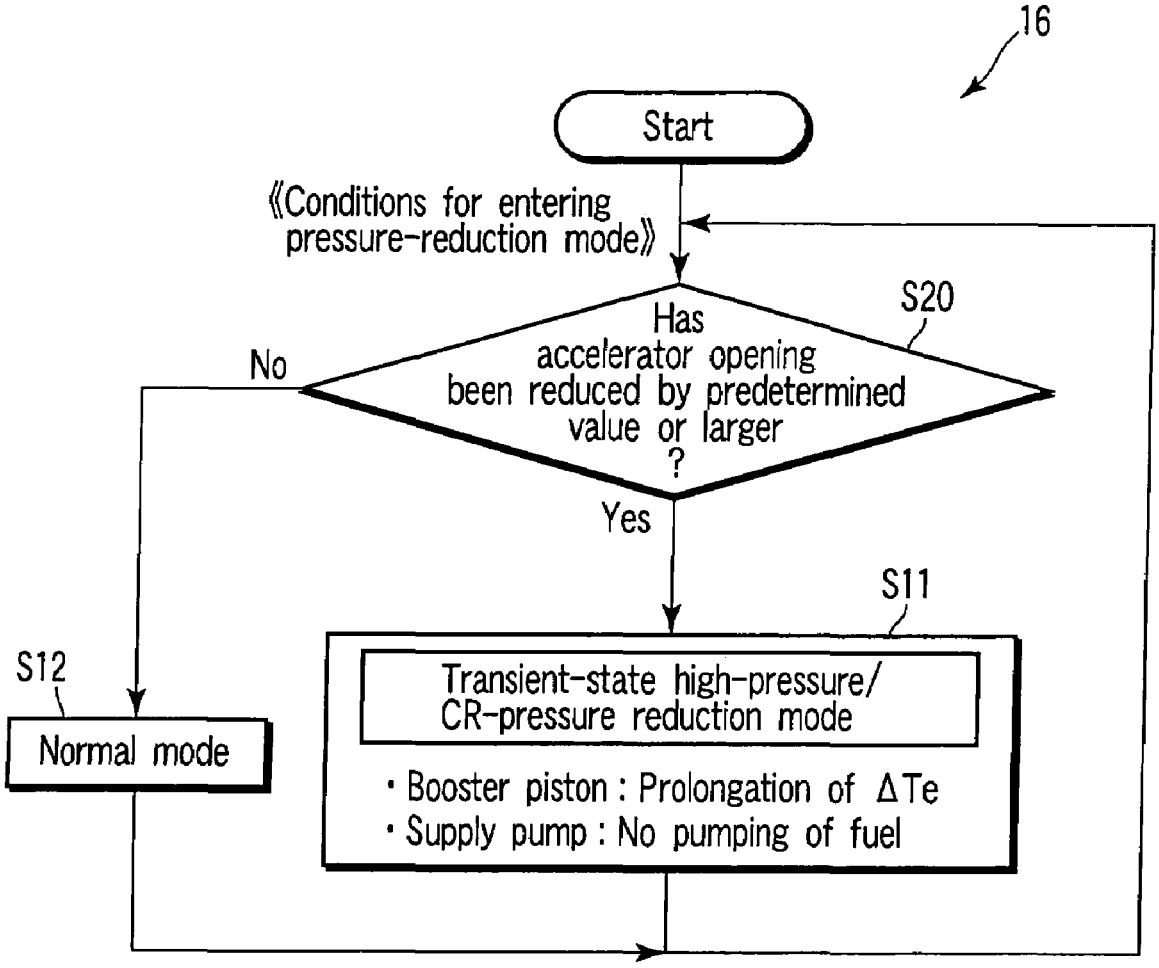
FIG. 7 is a view showing a part of functions of a controller according to a second embodiment of the invention.

FIG. 7 is a view showing a part of functions of a controller 16 according to a second embodiment of the invention. This embodiment includes a determination step S20 that functions as determination means for determining whether or not the accelerator opening is in a direction of reduction; and similarly as those in the first embodiment (FIG. 3), the embodiment includes a prolongation step S11 (pressure-reduction mode) and a step S12 (normal mode). Configurations and operations of those other than the determination step S20 are common to those in the above-described first embodiment, so that the common portions are shown with the same numerals/symbols as in the first embodiment, and descriptions thereof are not repeated here.

In the determination step S20 of the embodiment, the accelerator opening (the amount of acceleration pedal operation) is used as a determination criterion of whether or not to reduce the indication value of the common rail pressure. That is, in step S20 it is determined whether or not the accelerator opening is in the direction of reduction. When it is determined that the accelerator opening is in the direction of a significant reduction to be lower than a predetermined value (when an accelerator opening ratio has exceeded a set value), the operation proceeds to step S11. In step S11, the open time of the discharge valve 111 of the booster unit 70 is prolonged by ΔTe.

Accordingly, in the transient state of the engine such as in the state of transition from a high speed, high load zone to a low speed, low load zone, the pressure in the common rail 12 can be reduced in a short time. Consequently, occurrence of a response delay in such a transient state can be restrained, high pressure fuel injection can be prevented from being executed in a low load state, and hence exhaust gas emissions can be maintained in a preferable condition.

The invention may of course be practiced or carried out in various ways other than the above-described embodiments by appropriately modifying constitutional elements, such as the injectors, common rail, and controller, without departing from the essence and the scope and spirit of the invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A fuel injection system comprising:

a common rail which preserves a fuel pressurized;

a booster unit which intensifies the fuel supplied from the common rail thereby to transfer the fuel to a needle valve mechanism of an injector;

a needle valve drive unit which drives the needle valve of the needle valve mechanism to open or close; and a controller which controls the booster unit and the needle valve drive unit, wherein the booster unit has:

a pressure chamber which admits the fuel transferred from the common rail;

a booster piston provided in the pressure chamber;

a backpressure chamber which is separated by the booster piston from the pressure chamber and which admits the fuel transferred from the common rail;

a discharge valve which is able to discharge the fuel existing in the backpressure chamber; and a booster chamber which, when the fuel in the backpressure chamber is discharged, uses a portion moving integrally with the booster piston thereby to intensify the fuel and then transfers the fuel to the needle valve mechanism, the needle valve drive unit has:

a pressurization chamber which admits the fuel transferred from the common rail;

an open/close valve which is able to discharge the fuel existing in the pressurization chamber; and a pressure-receiving piston which is accommodated in the pressurization chamber and moves in the direction of opening the needle valve in conjunction with discharge of the fuel existing in the pressurization chamber, and the controller has:

prolongation means for prolonging an open time of the discharge valve when the booster unit operates in the event that necessity arises for reducing pressure in the common rail in correspondence to any one of an engine operation state and accelerator operation state.

2. A fuel injection system according to claim 1, wherein the controller further comprises:

indication-value setting means for setting an indication value of a target pressure in the common rail in correspondence to the engine operation state; and determination means for determining whether or not the indication value of the pressure in the common rail is in a direction of reduction to be lower in comparison to a previously set indication value, wherein, when the determination means has determined that the indication value is in the direction of reduction, the prolongation means prolongs the open time of the discharge valve of the booster unit.

3. A fuel injection system according to claim 2, wherein, when the determination means has determined that the indication value is in the direction of reduction and an amount of the reduction exceeds a predetermined value, the prolongation means of the controller prolongs the open time of the discharge valve of the booster unit.

4. A fuel injection system according to claim 2, wherein the indication-value setting means of the controller causes the indication value to increase when an engine speed and an engine load increase.

5. A fuel injection system according to claim 2, wherein the prolongation means acquires a maximum prolongation time ΔTe (seconds) for prolongation by:

$$\Delta Te=(120/Ne)-(t)-(\Delta Taf+\Delta Tred)$$

where Ne represents an engine speed (rpm); t represents an injection period; ΔTred represents a time necessary for reducing the pressure in an injector; and ΔTaf represents a setting margin time.

6. A fuel injection system according to claim 2, wherein, while the open time of the discharge valve is prolonged by the prolongation means, the controller causes a feed rate of a supply pump to supply the fuel to the common rail to be reduced or to be zero.

7. A fuel injection system according to claim 1, wherein the controller further has determination means for determining whether or not an accelerator opening is in a direction of reduction, and when the determination means has determined that the accelerator opening is in the direction of reduction, the prolongation means prolongs the open time of the discharge valve of the booster unit.

8. A fuel injection system according to claim 7, wherein, while the open time of the discharge valve is prolonged by the prolongation means, the controller causes a feed rate of a supply pump to supply the fuel to the common rail to be reduced or to be zero.

* * * * *